US010350936B1

(12) United States Patent
Zhu et al.

(10) Patent No.: US 10,350,936 B1
(45) Date of Patent: Jul. 16, 2019

(54) DOCUMENT FOLDER FOR STORAGE CABINETS

(71) Applicants: Shengbo Zhu, San Jose, CA (US); Su Shiong Huang, Belleville, WA (US)

(72) Inventors: Shengbo Zhu, San Jose, CA (US); Su Shiong Huang, Belleville, WA (US)

(73) Assignee: MICRODATA CORPORATION, San Jose, CA (US)

( * ) Notice: Subject to any disclaimer, the term of this patent is extended or adjusted under 35 U.S.C. 154(b) by 0 days.

(21) Appl. No.: 15/932,821

(22) Filed: May 1, 2018

(51) Int. Cl.
*A47B 63/06* (2006.01)
*B42F 15/00* (2006.01)

(52) U.S. Cl.
CPC ..... *B42F 15/0088* (2013.01); *A47B 63/06* (2013.01); *B42P 2221/02* (2013.01); *B42P 2241/10* (2013.01)

(58) Field of Classification Search
CPC .. B42F 15/0088; A47B 63/06; B42P 2221/02; B42P 2241/10
USPC ..... 340/8.1
See application file for complete search history.

(56) References Cited

U.S. PATENT DOCUMENTS 5,063,380 A * 11/1991 Wakura ..... G01S 7/4816 250/200
5,287,414 A * 2/1994 Foster ..... G06K 7/10079 382/100
5,424,858 A * 6/1995 Gillotte ..... H04B 10/114 340/539.32
5,767,532 A * 6/1998 Nishiguchi ..... B65G 1/1371 257/81
5,977,875 A * 11/1999 Lin ..... G06K 17/00 340/568.2
6,861,993 B2 * 3/2005 Waldner ..... G06K 7/10336 343/742
7,079,044 B1 * 7/2006 Stanfield ..... G06F 16/93 340/8.1
9,238,439 B2 * 1/2016 Huebner ..... B60R 7/04
2004/0174257 A1 * 9/2004 Kuhns ..... G06K 19/02 340/508

(Continued)

*Primary Examiner* — Daniell L Negron
*Assistant Examiner* — Kam Wan Ma

(57) ABSTRACT

A document storage system for removably storing individual documents. A shelved cabinet has a track receptacle mounted to the lower shelf surface adjacent the cabinet front. The track receptacle has a plurality of tracks extending from the cabinet front to the cabinet rear. Each track has an open slot extending from the front to the rear of the cabinet. The track also has a rearwardly extending lip providing a rearwardly directed open notch. The cabinet further includes a back with an inner surface and a pair of ohmic conductors mounted on the inner surface and extending laterally thereof. An electronically searchable flexible file folder has a thin main body portion and a header secured to the top of the main body portion. The header is dimensioned to be removably received in any track of the track receptacle with the main body portion slidably received in the slot. The header portion has visible indicator mounted on a first end; and a latch pawl located on the first end engageable with the notch when the file folder is installed in the track. A pair of probe pins is mounted on the other end of the header and are engageable with the pair of ohmic conductors when the file folder is installed in a track.

17 Claims, 6 Drawing Sheets

(56) References Cited

U.S. PATENT DOCUMENTS

| | | | | |
|---|---|---|---|---|
| 2007/0139285 | A1* | 6/2007 | Maruyama | G06K 19/07749 343/741 |
| 2008/0036606 | A1* | 2/2008 | Kuramoto | G06K 7/0008 340/572.7 |
| 2009/0167502 | A1* | 7/2009 | Erickson | G06K 7/0008 340/10.3 |
| 2009/0231140 | A1* | 9/2009 | Hong | G06K 7/10346 340/572.7 |
| 2009/0251290 | A1* | 10/2009 | Sakama | G06K 19/0723 340/10.1 |
| 2012/0001758 | A1* | 1/2012 | Zhu | G16H 10/60 340/572.8 |
| 2016/0083139 | A1* | 3/2016 | Zhu | B65D 25/205 206/459.5 |
| 2016/0113134 | A1* | 4/2016 | Zhu | B42F 21/065 361/679.01 |

* cited by examiner

DOCUMENT FOLDER FOR STORAGE CABINETS

BACKGROUND OF THE INVENTION

This invention relates to document retention in general, and more specifically to document storage and retrieval.

Individual documents are commonly retrievably stored in file folders designed to be removably installed in filing cabinets having one or more drawers slidably mounted therein, with each drawer having a laterally spaced pair of upper support rails for accommodating the individual file folders. Each file folder is a document receptacle formed from a single sheet of suitable material (typically durable paper stock) folded about the longitudinal center. Each leaf of a file folder is provided with a mechanical brace secured to the upper margin of the associated leaf. Each brace is provided with a pair of downwardly opening channels adjacent the opposite ends thereof and designed to receive the drawer support rails of the respective cabinet drawer when the file folder is installed in the drawer. Thus, the lateral spacing of the channels of the braces is chosen to match the lateral separation distance of the drawer support rails. In use, one or more documents are inserted into the folder space between leaves of the file folder, and the file folder is installed in one of the cabinet drawers by manipulating the file folder downward into an open cabinet drawer until the channels are received by the cabinet support rails. When the document is to be retrieved, the normally-closed cabinet drawer is opened, the file folder is either spread apart by the user and the desired document is removed from the folder, or the folder itself is removed from the cabinet support rails, spread apart, and the desired document is removed.

In order to provide some measure of security for a document storage and retrieval system of the type described above, and to facilitate the search for a file folder containing a sought document, various techniques have been introduced. One such technique uses computer controlled access to the individual file cabinet drawers. In a typical system of this type, the user enters a password and the system identifying code for the file folder or document being sought into a computer terminal connected to a system computer. If the password permits access to the system by the user, the system computer searches a system data base for the cabinet and drawer location of the item being sought, sends the address signals to the filing cabinets and, if a match is found, signals the cabinet in which the item resides to illuminate a visible indicator located on the drawer front of the drawer containing the file folder in which the sought item is presumably located and to unlock the drawer containing the sought item. The user is then permitted to open the drawer and search for the file folder. The file folders have visible indicators located along the upper margin, which can be activated when the file folder is the one sought. Once the file folder is located, the user can then extract the document sought. If the user disconnects any file folder brace from the cabinet support rails during this process, this event is detected by sensing circuitry in the cabinet and information regarding the identity of the disconnected file folder is transmitted back to the system computer. An example of such a file cabinet system is disclosed in U.S. Pat. No. 8,471,717 issued Jun. 25, 2013 for "Collective Objects Management System With Object Identification Using Addressable Decoder Units", the disclosure of which is hereby incorporated by reference.

Another document storage and retrieval system involves the use of notebook binders removably stored on shelves of open-faced cabinets. This type of binder management system utilizes a cabinet with shelves for removable storage of electronically searchable binders. Each binder has a body with front and rear covers and a spine. Inside the body is a binder mechanism for removably retaining documents. Each binder has externally extending upper and lower ohmic contact members which ohmically engage conductive members mounted on the confronting shelf surfaces near the front of the cabinet. Each binder has a binder identification circuit coupled to an LED mounted on the binder spine in a location visible when the binder rests on a shelf. When a binder identification signal from a host computer is presented to the shelf conductive members it is transferred by the binder contact members to the binder identification circuit. If the binder identification signal matches a code stored in the binder identification circuit, the binder LED is activated to aid the user in finding the binder. An LED and an optional audible indicator are mounted on the shelves to further aid the user in finding the sought binder. An example of this type of document storage and retrieval system is disclosed in U.S. Pat. No. 8,717,143 issued May 6, 2014 for "Searchable Binder", the disclosure of which is hereby incorporated by reference.

While the file cabinet/file folder arrangement and the notebook binder arrangement described above have been adopted for document storage and retrieval purposes, there are users who would prefer that file folders containing documents be retrievably stored on the shelves of open-faced cabinets. Such users disdain the use of notebook binders for storing a few documents since the binders occupy a relatively large amount of lateral shelf space compared to the thickness of the collection of documents contained in the binder. In addition, the document retaining mechanism-such as a three-ring binder-mechanically deforms the contained documents: for example, by requiring that holes be formed in each document-which is not always acceptable. Currently available file folders-such as those described above-are simply incompatible with open-faced cabinets having individual shelves. Consequently, the need exists for a document storage and retrieval system which employs relatively narrow electronically searchable file folders which can be removably stored on the shelves of open-faced cabinets.

A first attempt at such a system design made by the applicant is depicted in FIGS. 1-3. As seen in these Figs., a file folder 10 fabricated from a suitable material, such as plastic or durable paper stock, has an edge portion 12 containing system electronics (not shown) for enabling communication with a host computer. This electronic communication is enabled by spring-loaded probe pins 15A, 15B mounted at the top of edge portion 12 and spring-loaded probe pins 16A, 16B mounted at the bottom edge of edge portion 12. A pair of LEDs 17, 18 is mounted on edge portion 12: one of which is activated when the file folder 10 is inserted into a track receptacle described below and power is applied to the system electronics, the other of which is activated when the folder address stored in file folder 10 matches an inquiry address from the host computer. File folder 10 is also equipped with a maneuvering handle 19 to facilitate insertion and removal of file folder 10 in the track receptacle.

As best shown in FIG. 3, a conventional open-faced shelved cabinet is provided with upper and lower track receptacles 20, 22 which provide mechanical support for file folders 10 and ohmic connection between probe pins 15Am 15B, 16A, 16B and data and electrical power sources. Upper and lower track receptacles 20, 22 are essentially identical in construction and each includes a plurality of laterally spaced, vertically extending guides 23 for slidably accommodating the upper and lower portions of each file folder 10. Each track receptacle is provided with an electrically conductive strip (not shown) which extends laterally of the cabinet opening and is positioned to make ohmic contact with probe pins 15A, 15B, 16A, 16B when a file folder is installed. To install a file folder 10, the file folder 10 is grasped by the handle 19 with one hand, the other hand helps to steady the file folder 10 in the vertical direction while the upper and lower portions of file folder 10 are inserted into the space between adjacent guides, and the file folder is advanced into the track receptacles 20, 22 until the rear edge encounters a limit stop. To remove, the user simply grasps the handle 19 and pulls in the outward direction until the file folder 10 is free of the track receptacles 20, 22.

While functional, the design of FIGS. 1-3 suffers from several disadvantages. Firstly, when a file folder is moving inwardly of the track receptacles 20, 22 the probe pins 15A, 15B, 16A, 16B encounter a horizontal force due to friction between them and the confronting surface of the track receptacles 20, 22. This can cause excessive wear and premature failure of a given probe pin. Further, the relatively thin nature of the file folder 10 causes deflection from side to side during insertion, which makes the installation process somewhat unwieldy. In addition, the portrait orientation of an installed file folder 10 (i.e., the larger dimension is in a vertical orientation, while the smaller dimension is in a horizontal orientation) requires a greater minimum vertical separation between adjacent shelves in the cabinet, which dictates either a cabinet having a substantially larger vertical dimension or a cabinet having fewer vertically spaced shelves. Efforts to date to design a document storage and retrieval system devoid of these disadvantages and which employs relatively narrow electronically searchable file folders which can be removably stored between adjacent shelves of open-faced shelved cabinets have not met with success.

SUMMARY OF THE INVENTION

The invention comprises a document storage and retrieval system which employs relatively narrow electronically searchable file folders which can be removably stored between adjacent shelves of open-faced cabinets and which is devoid of the disadvantages noted above.

In a first aspect, the invention comprises an electronically searchable document file folder for use in a cabinet having at least one shelf with a track receptacle for providing removable storage for file folders, the file folder comprising a main body portion having a top, a bottom edge and opposing side edges; and a header portion secured to the top, the header portion being dimensioned to be removably received by the track receptacle for support thereby; the header portion having a first end and a second end; at least one visible indicator mounted on the first end of the header portion; a latch pawl located on the first end of the header portion; a pair of probe pins mounted on the second end of the header portion; and an opening in one of the side and the bottom edges for providing access to the interior of the file folder for insertion and removal of documents.

The visible indicator is preferably an LED.

Each of the pair of probe pins preferably comprises a spring-loaded retractable pin.

The latch pawl preferably comprises an outward extension of the first end of the header portion.

In a second aspect, the invention comprises a document storage system for removably storing individual documents, the system comprising:

a cabinet having at least one shelf with an upper surface and a lower surface, the cabinet having a track receptacle mounted to the lower surface adjacent a front portion of the cabinet, the track receptacle having at least one track extending from the front portion of the cabinet towards a rear portion of the cabinet, the track having an open slot formed therein extending from the front portion towards the rear portion of the cabinet, the track having a rearwardly extending lip providing a rearwardly directed open notch, the cabinet further including a back with an inner surface and a pair of ohmic conductors mounted on the inner surface and extending laterally thereof; and a file folder comprising a main body portion having a top, a bottom edge and opposing side edges; and a header portion secured to the top, the header portion being dimensioned to be removably received in the track of the track receptacle with the main body portion slidably received in the slot; the header portion having a first end and a second end; at least one visible indicator mounted on the first end of the header portion; a latch pawl located on the first end of the header portion and engageable with the notch when the file folder is installed in the track; a pair of probe pins mounted on the second end of the header portion and engageable with the pair of ohmic conductors when the file folder is installed in the track; and an opening in one of the side and the bottom edges for providing access to the interior of the file folder for insertion and removal of documents.

The track receptacle preferably extends along the width of the shelf and includes a plurality of laterally spaced tracks.

The cabinet preferably includes a plurality of shelves each provided with a track receptacle.

File folders fabricated according to the teachings of the invention provide easily installable and removable storage of documents in open-faced shelved cabinets having special track receptacles installed therein. The file folders are vertically suspended in the tracks of the track receptacles using the relatively rigid header portions. In addition, the file folders can easily be engaged in the tracks in the track receptacles using one hand. Further, the landscape orientation of an installed file folder (i.e., the larger dimension is in a horizontal orientation, while the smaller dimension is in a vertical orientation) requires a smaller minimum vertical separation between adjacent shelves in the cabinet, which allows either a cabinet having a substantially smaller vertical dimension or a cabinet having more vertically spaced shelves than the design of the units shown in FIGS. 1-3. Lastly, the fact that the probe pins are devoid of sliding contact with stationary elements during insertion and removal of a file folder eliminates destructive horizontal forces on the probe pins, thereby prolonging the useful life of these elements.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 4:
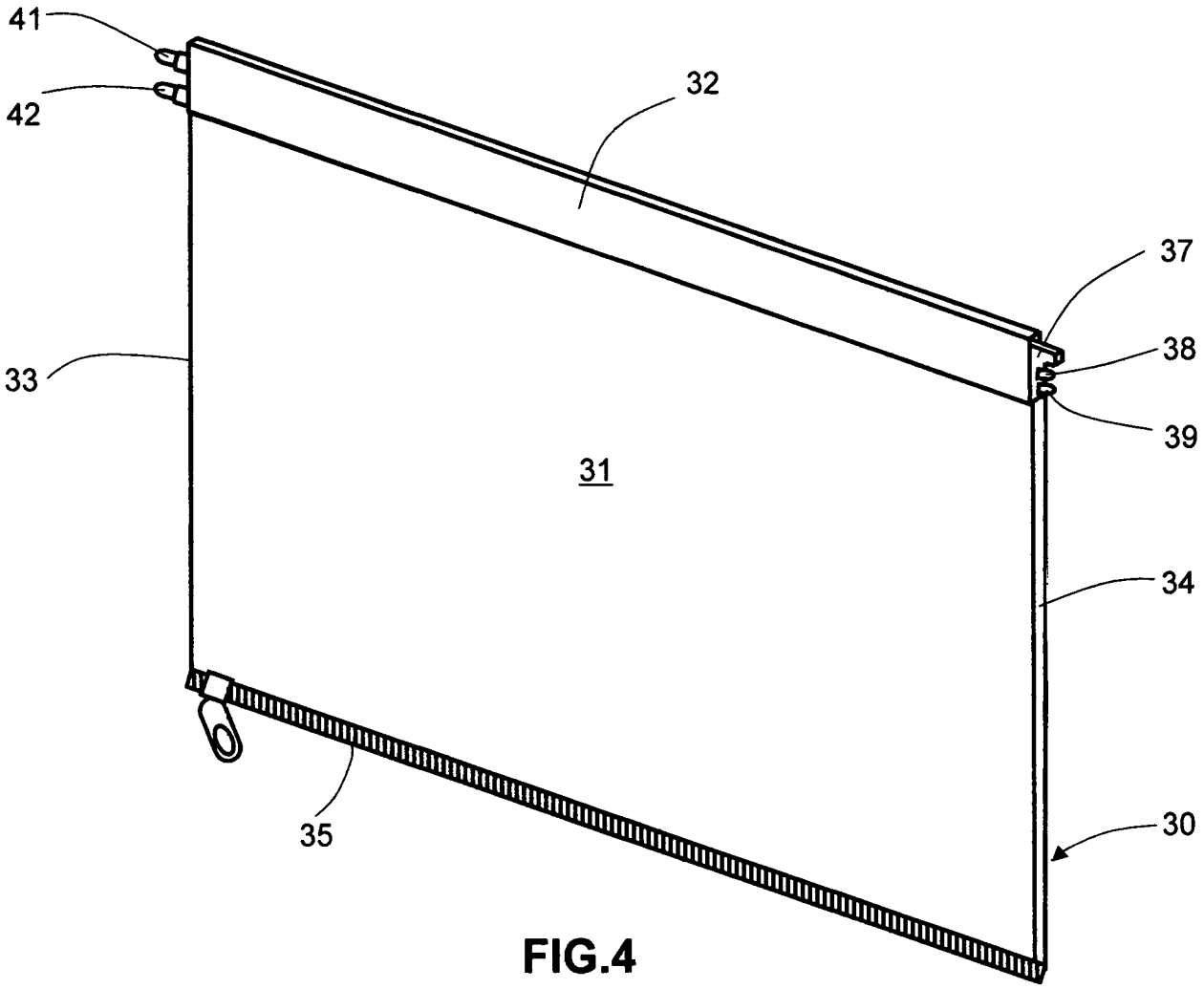
FIG. 4 is a perspective view of a file folder according to the invention.
Figure 5:
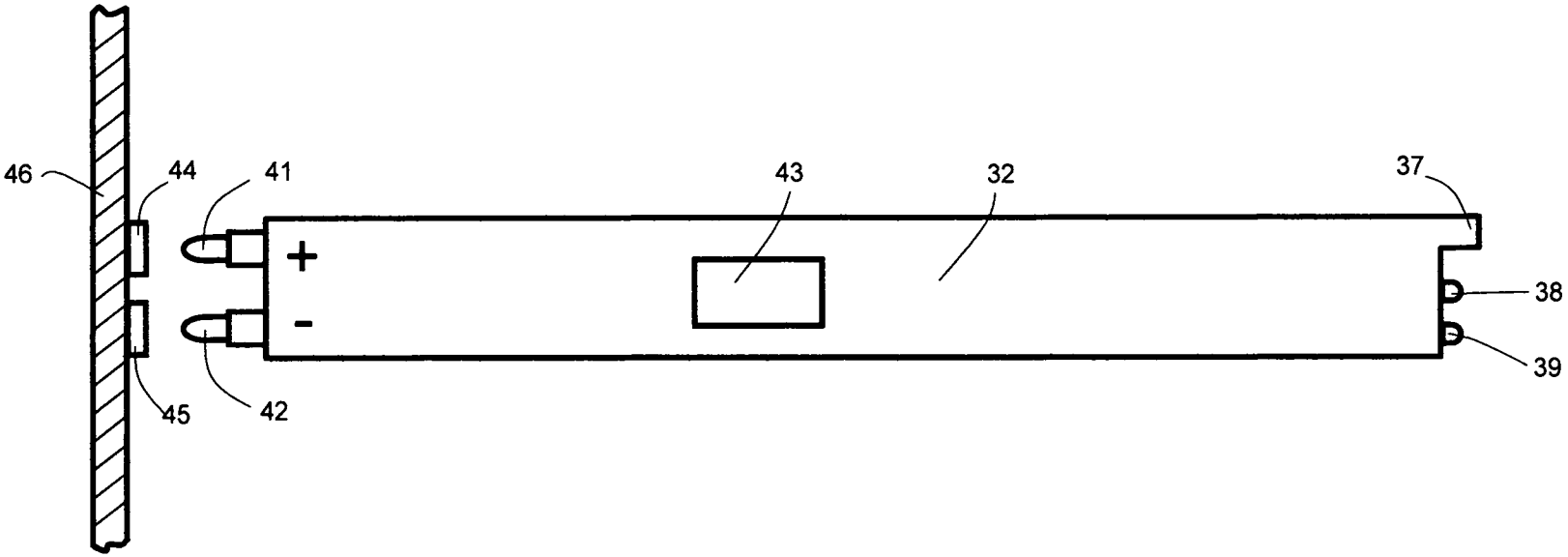
FIG. 5 is a schematic side view illustrating the upper portion of the file folder of FIG. 4 positioned adjacent a pair of cabinet mounted ohmically conductive strips.

Turning now to the drawings illustrating the invention, FIG. 4 is a perspective view of a file folder according to the invention. As seen in this Fig, a file folder 30 has a relatively thin, flexible main body portion 31 and a relatively thicker and rigid upper header portion 32. In the embodiment of FIG. 4, the main body portion 31 is permanently sealed at the top and both edges 33, 34, and is provided with a zipper-like mechanism along the bottom edge 35 for providing access to the interior of file folder 30. This enables one or more documents to be manually inserted and removed from the interior of file folder 30. The upper header portion 32 is fabricated from a suitable durable material, such as printed circuit board material, capable of being formed to the shape depicted and suitable for mounting the electronic components noted below along with electrically conductive paths therebetween. Upper header portion 32 has an outer end provided with a latch pawl 37 and two visible indicators (preferable LEDs) 38, 39 for signifying power present and an address match. The inner end of upper header portion 32 is provided with a pair of spring-loaded probe pins 41, 42. Probe pins 41, 42 are preferably a type BGA-030-570DF unit available from Shenzhen Electro Corp. of China. As best seen in FIG. 5, probe pins 41, 42 are vertically spaced with a separation distance designed to mate with electrically conductive strips 44, 45, mounted on a back wall 46 of a conformable cabinet when a file folder is fully installed in the manner described below. As also seen in FIG. 5, a microcontroller unit (MCU) 43 is mounted on upper header portion 32. MCU 43 is ohmically connected by conductive paths (not shown) to LEDs 38, 39 and probe pins 41, 42. MCU 43 is preferably a type PCI 10F202 unit available from Microchip Technology of Chandler, Ariz.

Figure 6:
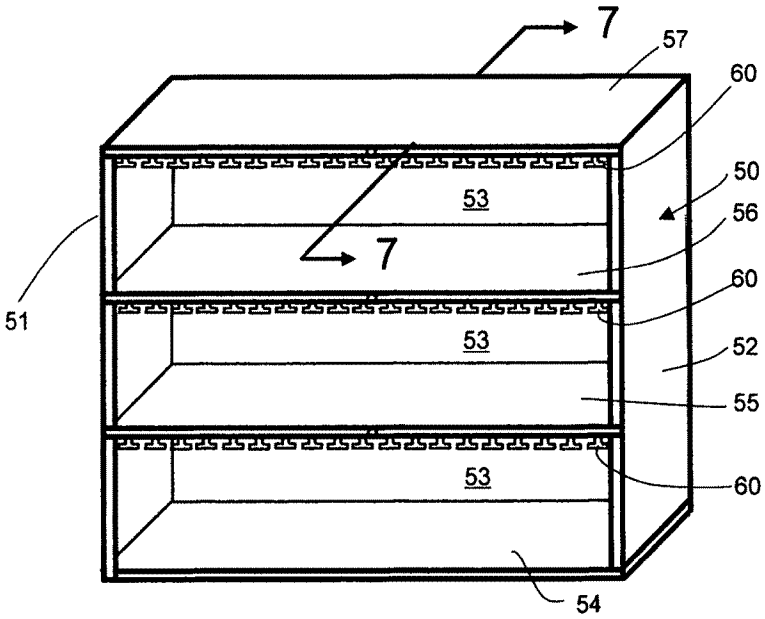
FIG. 6 is a perspective view of a cabinet configured to accommodate the file folder of FIG. 4.
Figure 7:
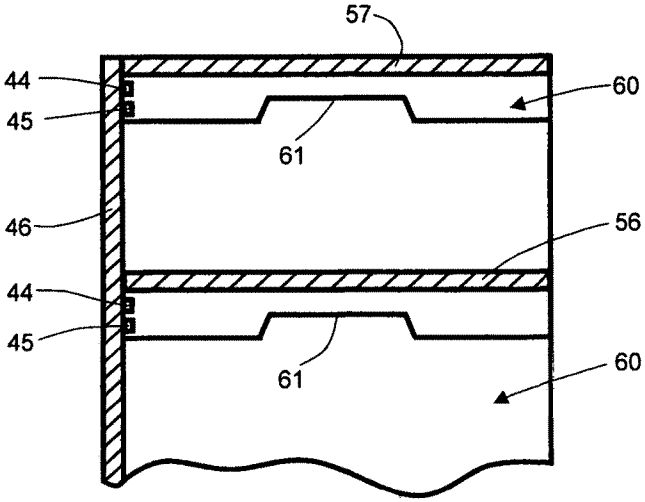
FIG. 7 is an enlarged partial sectional view taken along lines 7-7 of FIG. 6 illustrating the side profile of two file folder track receptacles.

FIG. 6 is a perspective view of an open-faced shelved cabinet configured to provide functional support for file folders fabricated according to the invention. As seen in this Fig., a cabinet 50 has an open front, a left side 51, a right side 52, a back side 46, a bottom shelf 54, intermediate shelves 55, 56, and a top shelf 57 which also serves as the top of the cabinet. Secured to the underside of shelves 55, 56, and 57 are individual identical track receptacles 60 shown in greater detail in FIG. 8. Each track receptacle 60 preferably spans the entire interior width of cabinet 50. FIG. 7 illustrates the side profile of each track receptacle 60 which is an essentially rectangular profile with an upward central relieved portion 61 to save material cost. FIG. 7 also illustrates the placement of conductive strips 44, 45, which extend along the entire width of cabinet 50 on the interior surface of back side 46.

Figure 8:
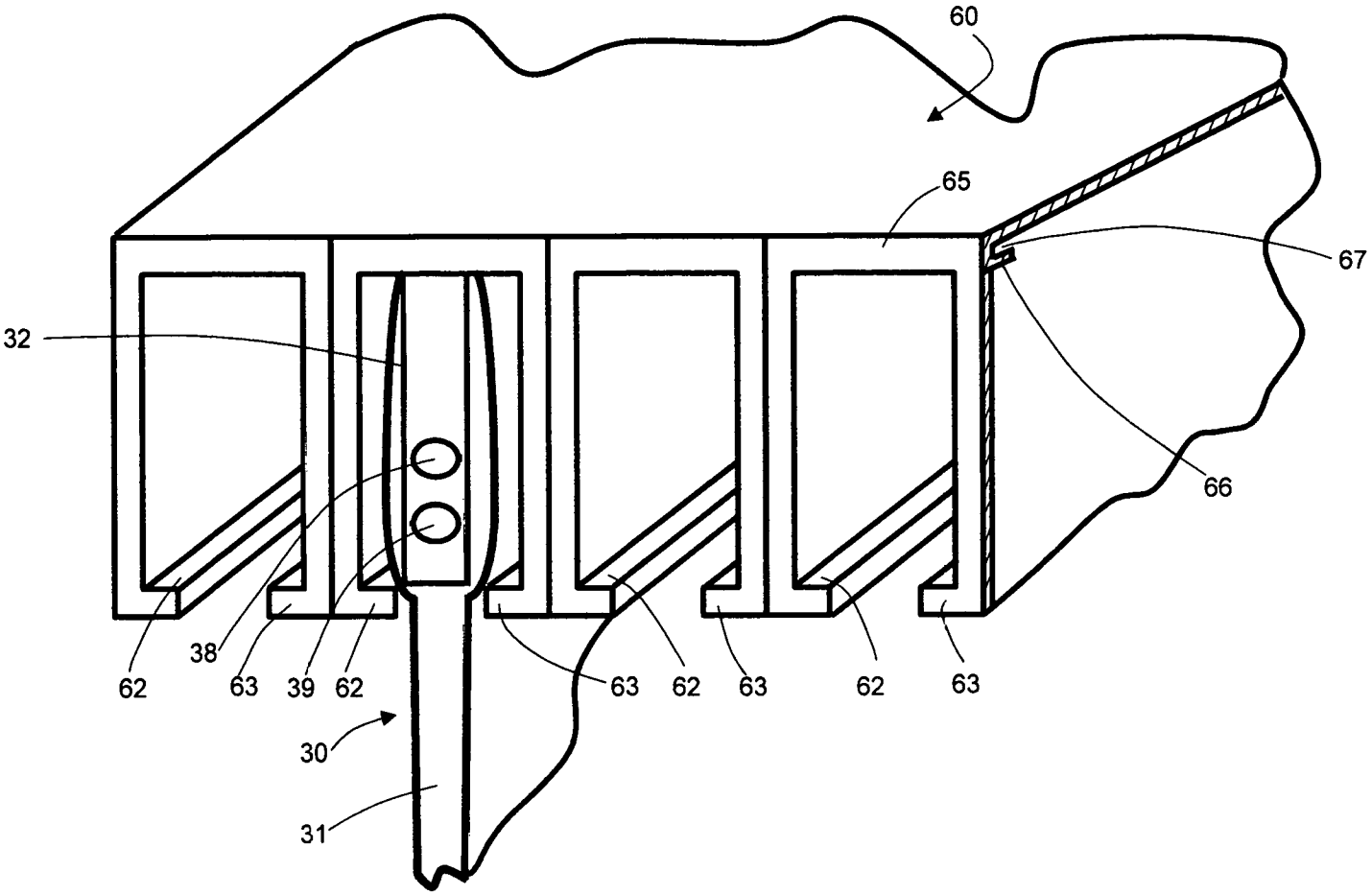
FIG. 8 is an enlarged partial perspective view illustrating a single file folder of the FIG. 1 design installed in a single track.

FIG. 8 illustrates in greater detail the configuration of each track receptacle 60 and shows a single file folder 30 fully inserted in one of the tracks in one of the track receptacles 60. Each track has an essentially rectangular opening bounded by track walls and a lower slot defined by a pair of ledges 62, 63 extending toward one another. The width of the slot is greater than the width of main body portion 31 of file folder 30 in order to accommodate sliding motion between file folder 30 and the track. The width of the slot is also less than the width of header portion 32 of file folder 30 so as to provide vertical support for the file folder 30 when installed in the track. The upper wall portion 65 of each track has an inwardly extending lip 66 forming a notch 67.

Figure 9A:
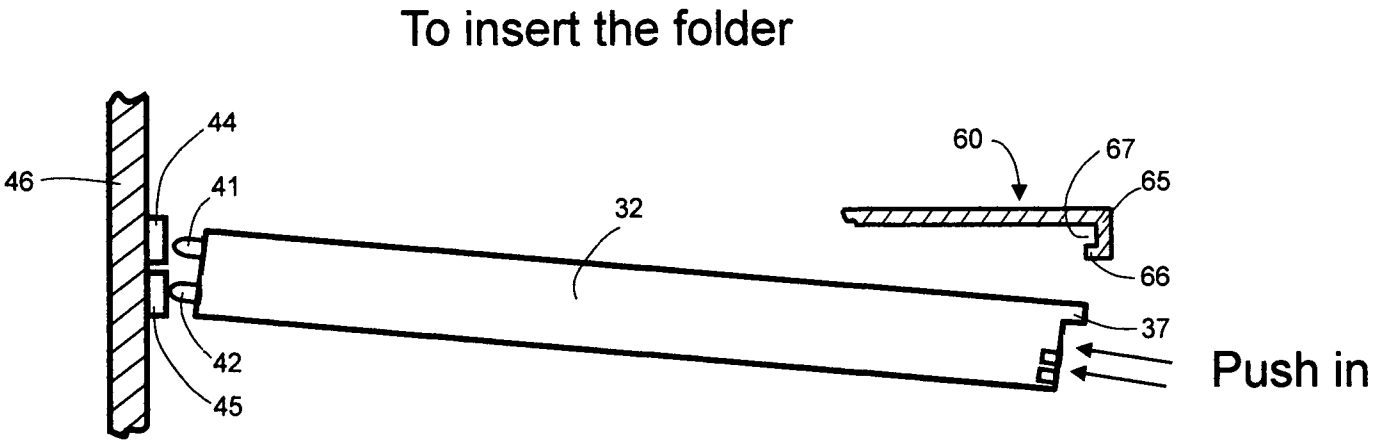
FIGS. 9A and 9B illustrate the process of installing a file folder according to the invention into a cabinet track.
Figure 9B:
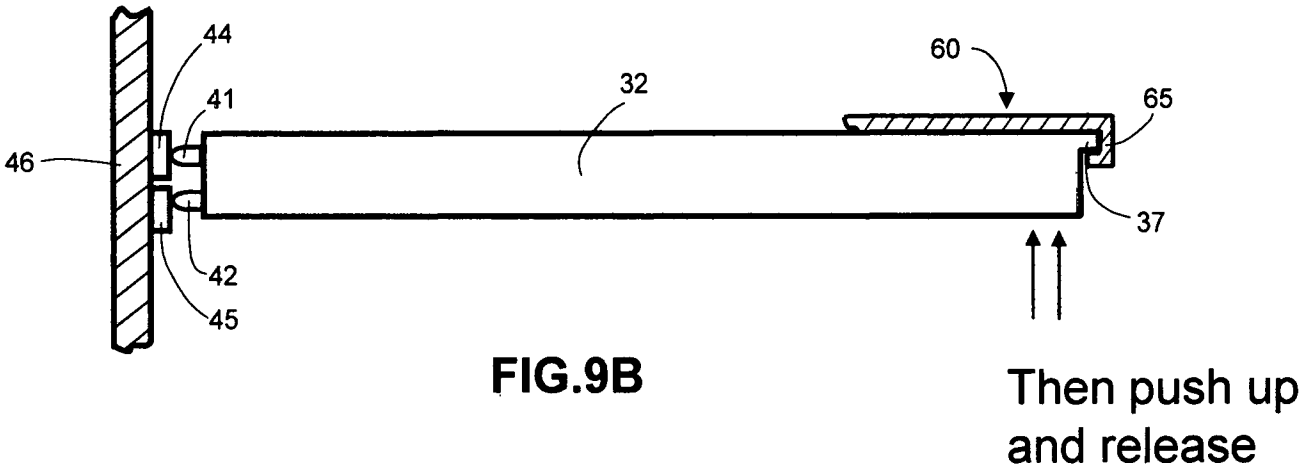

FIGS. 9A and 9B illustrate the installation process for installing a file folder 30 in a track in a secure fashion. Initially, the header portion 32 of a file folder 30 is maneuvered into a track in a slightly tilted position as shown in FIG. 9A. The file folder 30 is then pushed into the track until at least one of the probe pins 41, 42 makes contact with at least one of the conductive strips 44, 45 and latch pawl 37 clears inwardly extending lip 66. The outer portion of file folder 30 is then manipulated upwardly until latch pawl 37 is positioned in alignment with notch 67. Manual pressure on the file folder 30 is then released and the header portion 32 of folder 30 is free to move outwardly of track receptacle 60 under the force of the spring-loaded probe pins 41, 42 until latch pawl 37 is firmly engaged in notch 67. In this position, probe pins 41, 42 make effective ohmic contact with conductive strips 44, 45 while file folder 30 is firmly secured within the track of the track receptacle 60. Removal of file folder 30 is the reverse of the installation process.

Figure 2:
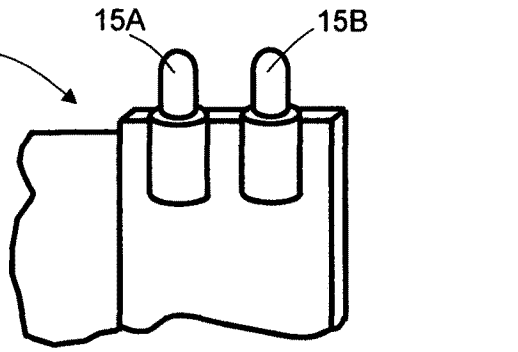
FIG.2 PRIOR ART
FIG. 2 is an enlarged perspective view illustrating the retractable probe pins mounted to the upper and lower portions of the file folder of FIG. 1.
Figure 3:
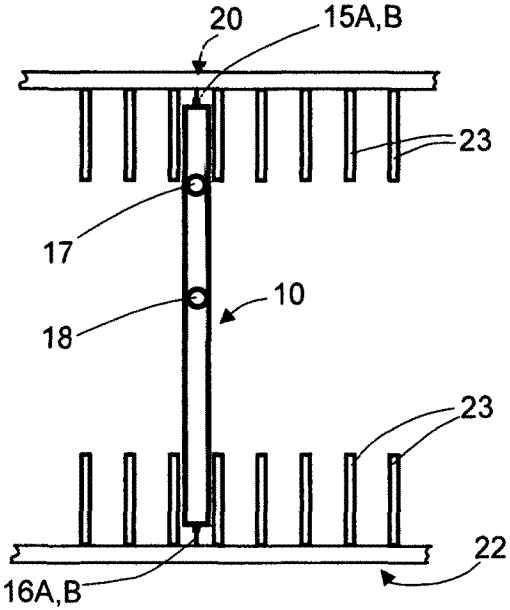
FIG.3 PRIOR ART
FIG. 3 is a schematic front view of a portion of a cabinet illustrating a single file folder of the type shown in FIG. 1 installed in a pair of track receptacles mounted in a cabinet.
Figure 1:
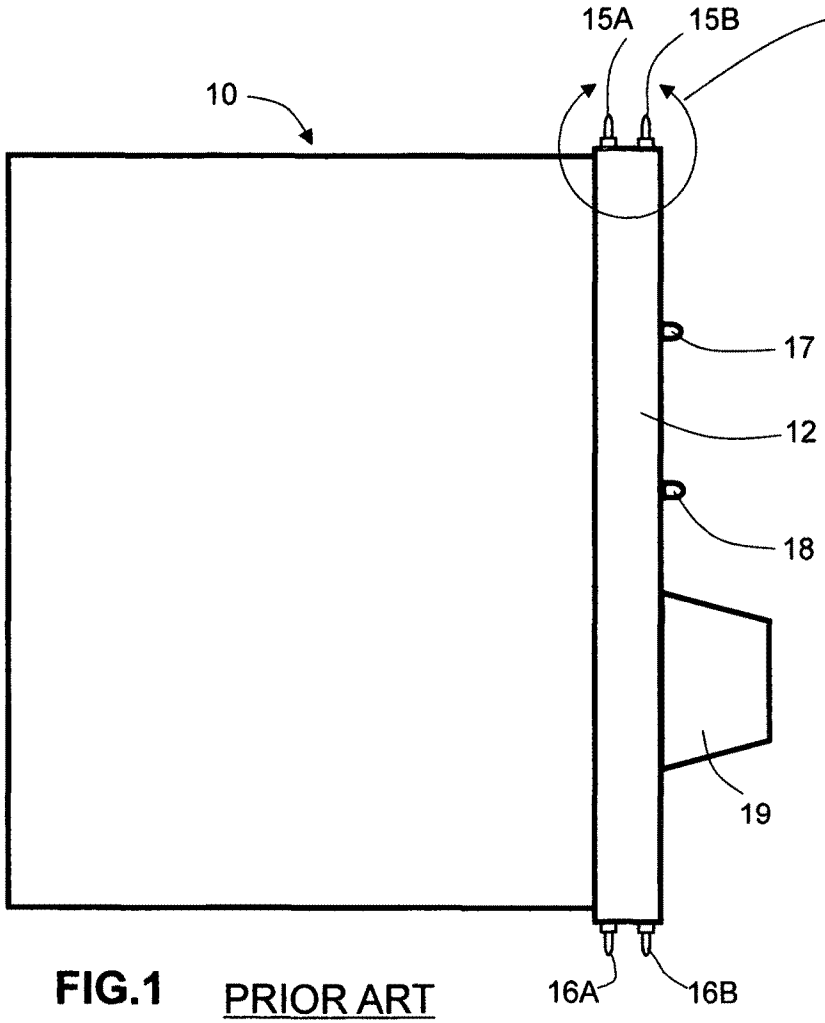
FIG.1 PRIOR ART
FIG. 1 is a side elevational view of a prior art file folder designed for use with an open-faced shelved cabinet for removably storing file folders for documents.

As will now be apparent, file folders fabricated according to the teachings of the invention provide easily installable and removable storage of documents in open-faced shelved cabinets having special track receptacles 60 installed therein. The vertical suspension of the file folders 30 is enhanced by the fact that the file folders 30 are suspended using the relatively rigid header portions 32. In addition, the file folders 30 can easily be engaged in the tracks in the track receptacles 60 using one hand. Further, the landscape orientation of an installed file folder 30 (i.e., the larger dimension is in a horizontal orientation, while the smaller dimension is in a vertical orientation) requires a smaller minimum vertical separation between adjacent shelves in the cabinet, which allows either a cabinet having a substantially smaller vertical dimension or a cabinet having more vertically spaced shelves than the design of the units shown in FIGS. 1-3. Lastly, the fact that the probe pins 41, 42 are devoid of sliding contact with stationary elements during insertion and removal of a file folder 30 eliminates destructive horizontal forces on the probe pins 41, 42, thereby prolonging the useful life of these elements.

Although the above provides a full and complete disclosure of the preferred embodiments of the invention, various modifications, alternate constructions and equivalents will occur to those skilled in the art. For example, while the invention has been described with reference to specific materials used in the fabrication of the main body portion of the file folder 30, other suitable materials will occur to those of ordinary skill in the art. In addition, if desired the FIG. 4 embodiment may be modified by fabricating the file folder 30 is accordance with any of the embodiments shown in U.S. Pat. No. 9,676,223 issued Jun. 13, 2017 for "Secure Document Receptacle", the disclosure of which is hereby incorporated by reference. Moreover, different types of bottom edge enclosure mechanisms may be employed in the FIG. 4 embodiment, such as Velcro-type strips, mechanical snaps or the like. Therefore, the above should not be construed as limiting the invention, which is defined by the appended claims.

What is claimed is:

1. An electronically searchable document file folder for use in a cabinet having at least one shelf with a track receptacle for providing removable storage for file folders, said file folder comprising a main body portion having a top, a bottom edge and opposing side edges; and a header portion secured to said top, said header portion being dimensioned to be removably received by the track receptacle for support thereby; said header portion having a first end and a second end; at least one visible indicator mounted on said first end of said header portion; a latch pawl located on said first end of said header portion; a pair of probe pins mounted on said second end of said header portion; and an opening in one of said side and said bottom edges for providing access to the interior of said file folder for insertion and removal of documents.

2. The invention of claim 1 wherein said at least one visible indicator comprises an LED.

3. The invention of claim 1 wherein said header portion has a pair of visible indicators mounted on said first end.

4. The invention of claim 3 wherein said pair of visible indicators comprises a pair of LEDs.

5. The invention of claim 1 wherein said latch pawl comprises an outward extension of said first end of said header portion.

6. The invention of claim 1 wherein each of said pair of probe pins comprises a spring-loaded retractable pin.

7. The invention of claim 1 wherein said file folder has a long dimension;

and wherein said header portion of said file folder extends along said long dimension of said file folder so that said file folder can be suspended in landscape mode.

8. A document storage system for removably storing individual documents, said system comprising:

a cabinet having at least one shelf with an upper surface and a lower surface, said cabinet having a track receptacle mounted to said upper surface adjacent a front portion of said cabinet, said track receptacle having at least one track extending from said front portion of said cabinet towards a rear portion of said cabinet, said track having an open slot formed therein extending from said front portion towards said rear portion of said cabinet, said track having a rearwardly extending lip providing a rearwardly directed open notch, said cabinet further including a back with an inner surface and a pair of ohmic conductors mounted on said inner surface and extending laterally thereof; and a file folder comprising a main body portion having a top, a bottom edge and opposing side edges; and a header portion secured to said top, said header portion being dimensioned to be removably received in said track of said track receptacle with said main body portion slidably received in said slot; said header portion having a first end and a second end; at least one visible indicator mounted on said first end of said header portion; a latch pawl located on said first end of said header portion and engageable with said notch when said file folder is installed in said track; a pair of probe pins mounted on said second end of said header portion and engageable with said pair of ohmic conductors when said file folder is installed in said track; and an opening in one of said side and said bottom edges for providing access to the interior of said file folder for insertion and removal of documents.

9. The system of claim 8 wherein said track receptacle extends along the width of said shelf and includes a plurality of laterally spaced tracks.

10. The system of claim 9 when said track receptacle extends across the entire width of said shelf.

11. The system of claim 8 wherein said cabinet includes a plurality of shelves each provided with a track receptacle.

12. The system of claim 8 wherein said at least one visible indicator comprises an LED.

13. The system of claim 8 wherein said header portion has a pair of visible indicators mounted on said first end.

14. The system of claim 13 wherein said pair of visible indicators comprises a pair of LEDs.

15. The system of claim 8 wherein said latch pawl comprises an outward extension of said first end of said header portion.

16. The system of claim 8 wherein each of said pair of probe pins comprises a spring-loaded retractable pin.

17. The system of claim 8 wherein said file folder has a long dimension; and wherein said header portion of said file folder extends along said long dimension of said file folder so that said file folder can be suspended in landscape mode.

* * * * *